US006357820B1

(12) United States Patent
Nagatsuka et al.

(10) Patent No.: US 6,357,820 B1
(45) Date of Patent: Mar. 19, 2002

(54) WORK VEHICLE

(75) Inventors: Isao Nagatsuka, Hanyu; Takeshi Endou, Shimizu; Junji Mimuro, Sayama; Hirofumi Tanaka, Yokohama, all of (JP)

(73) Assignee: Komatsu Limited, Tokyo (JP)

( * ) Notice: Subject to any disclaimer, the term of this patent is extended or adjusted under 35 U.S.C. 154(b) by 0 days.

(21) Appl. No.: 09/645,052

(22) Filed: Aug. 23, 2000

(30) Foreign Application Priority Data

Aug. 26, 1999 (JP) ..... 11-240506

(51) Int. Cl.[7] ..... B62D 25/10

(52) U.S. Cl. ..... 296/190.06; 296/190.05; 180/89.14; 180/89.18

(58) Field of Search ..... 296/190.04, 190.05, 296/190.06, 190.07; 180/89.14, 89.15, 89.16, 89.18, 89.17

(56) References Cited

U.S. PATENT DOCUMENTS 4,040,501 A * 8/1977 Haswell ..... 180/89.18
4,221,274 A * 9/1980 Martin, Jr. ..... 180/89.14
4,311,205 A * 1/1982 Goodacre et al. ... 296/190.05 X
5,042,602 A * 8/1991 Nakatani et al. ..... 180/89.14 X
5,303,792 A * 4/1994 Shimizu ..... 180/89.17
5,547,244 A 8/1996 Lee
5,551,826 A * 9/1996 Todd et al. ..... 180/89.14 X

FOREIGN PATENT DOCUMENTS

EP 0496886 A1 * 8/1992 ..... 296/190.05
WO WO-9721879 A1 11/1996

* cited by examiner

*Primary Examiner*—Stephen T. Gordon
*Assistant Examiner*—Jason Morrow
(74) *Attorney, Agent, or Firm*—Eugene Lieberstein; Michael Meller; Anderson Kill & Olick

(57) ABSTRACT

A work vehicle is provided that permits easy routine daily inspection services of a rear mounted engine in the vehicle. The vehicle has a cab covering a rear engine compartment. The cab is pivotally mounted on the frame of the vehicle. An engine hood is in turn pivotally mounted on the cab and covers the engine in the engine compartment. Accordingly, the hood can be pivoted or rotated to expose the engine for routine daily maintenance while the cab and the engine hood can be pivoted or rotated to expose the entire engine compartment for periodic heavy duty maintenance.

6 Claims, 3 Drawing Sheets

11 Side plate
12 Cover plate

| | |
|---|---|
| 1 | Frame |
| 2 | Front wheel |
| 3 | Rear wheel |
| 4 | Bucket |
| 5 | Work equipment |
| 6 | Driver's seat |
| 7 | Cab |
| 8 | Engine |
| 9 | Radiator |
| 10 | Engine hood |

11 Side plate
12 Cover plate

WORK VEHICLE

The present invention relates to a work vehicle. More particularly, the present invention relates to a work vehicle apparatus for improving the maintenance and upkeep of the vehicle and its engine.

BACKGROUND OF THE INVENTION

In a work vehicle, particularly, in compact construction equipment, the bucket for digging and scooping earth and sand, etc., and other work equipment are provided at the front of the vehicle body. The engine is mounted at the rear of the vehicle in order to improve stability in the longitudinal direction of the vehicle during operation. The construction vehicle disclosed in Kokai Utility Model No. Hei 2[1990]-12981 is one example of this type of work vehicle. It has a recessed part for fitting the front part of the engine into the bottom rear part of the vehicle cab. It also has an engine cover which covers the rear of the engine up to the rear edge of the aforementioned recessed part and rotates freely. Inspection of the engine is carried out by rotating the engine cover upwardly to expose the rear part of the engine.

Also, the agricultural work machine disclosed in Kokai Patent Application No. Hei 11[1999]-59505 has the engine arranged below the driver's seat. The seat forms the cover which covers the engine. The cab covers the driver's seat as one unit, and the engine section is exposed by rotating the cab forward with the bottom front of the cab as the rotating axis. Another example of such a work vehicle is constructed to rotate the cab towards the rear of the vehicle. In this case the fulcrum is necessarily at the rear of the cab. It is provided with an engine cover capable of opening and closing to the rear of the vehicle.

However, the aforementioned conventional work vehicles respectively have the following problems:

(1) The construction vehicle disclosed in Kokai Utility Model Application No. Hei 2[1990]-12981 can open only the rear part of the engine compartment. This is true even if it needs to be opened wide for repair or replacement of the hydraulic equipment or engine. Therefore, the cab has to be removed when mounting or removing the engine, etc., thereby consuming a lot of time.

(2) The agricultural machine disclosed in Kokai Patent Application No. Hei 11[1999]-59505 cannot expose the engine unless the cab is rotated forward by about 90°. Therefore, the entire heavy cab has to be rotated even when the entire engine compartment need not be fully opened, such as for daily inspection of the engine, etc.

(3) Some work vehicles are constructed so that the cab rotates towards the rear of the car body. Clearly attachment and removal of the engine with such an arrangement can be quite difficult. Also, there are problems with such cab rotation being in the way when inspecting the engine, since the rotated cab protrudes approximately horizontally to the rear when the engine cover is opened.

SUMMARY OF THE INVENTION

The present invention focuses attention on the aforementioned problems of conventional apparatus and provides a work vehicle cab which facilitates efficient job execution even during repair or installation and removal of the engine or hydraulic equipment that may be located in the engine compartment.

In order to achieve such objective, a first embodiment of the present invention provides apparatus in a work vehicle having a frame and an engine arranged in a rear mounted engine compartment. The apparatus includes a cab mounted between the front and rear ends of the vehicle for accommodating a vehicle operator and covering the engine compartment. Pivoting means are coupled to the cab and the frame for permitting the cab to be pivoted away from the rear of the vehicle and uncover the engine compartment when desired. Also, an engine hood is provided covering the engine and pivotally coupled to the cab. The engine hood can be pivoted separately from the cab to expose the engine and the cab and engine hood together can be pivoted away from the rear of the vehicle to uncover and expose the engine compartment.

In another embodiment, the engine hood has side plates and a cover plate. The cover plate is pivotally mounted to expose the engine.

In a further embodiment, the engine hood has side plates fixedly mounted on the cab. A cover plate is pivotally mounted on the side plates to expose the engine when the cover pate is pivoted.

In still another embodiment the side plates are integrally formed with the cab so as to pivot with the cab.

In the preferred embodiments, the cab is free to rotate at least ninety degrees from its engine compartment covering position by the pivoting means. The engine hood is also free to rotate substantially ninety degrees with respect to the engine.

According to the aforementioned embodiments of the present invention, the engine compartment can be exposed to permit daily engine inspection by rotating the engine hood or just the cover plate. Thus the inspection can be performed efficiently. Also, by opening the engine hood, and pivoting the cab forward, the entire engine compartment including the engine, hydraulic equipment, etc., located below the cab is exposed. Thus repair, replacement, etc., of these components can be executed smoothly and quickly. Therefore, a cab with superior maintenance characteristics than in the prior art is created for the work vehicle.

BRIEF DESCRIPTION OF THE DRAWINGS

Other features and advantages of the present invention will be understood from the following detailed "Description of the Preferred Embodiments", made with reference to the appended drawings in which.

DESCRIPTION OF THE PREFERRED EMBODIMENTS

Figure 1:
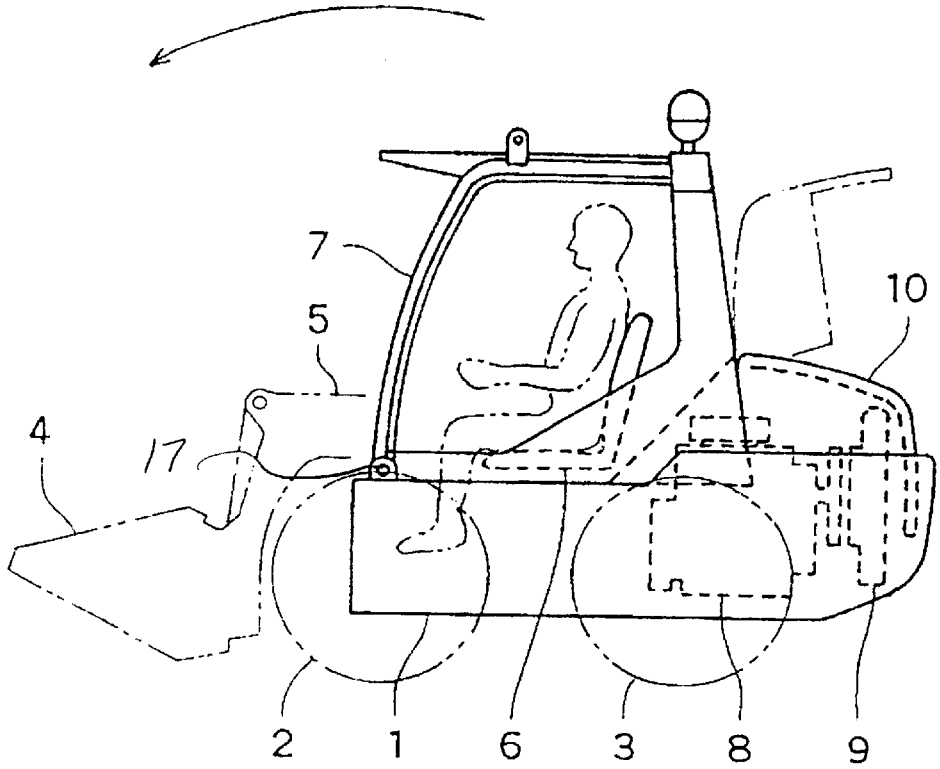
FIG. 1 is a side view of a first embodiment of a work vehicle incorporating the principles of the present invention.
Figure 2:
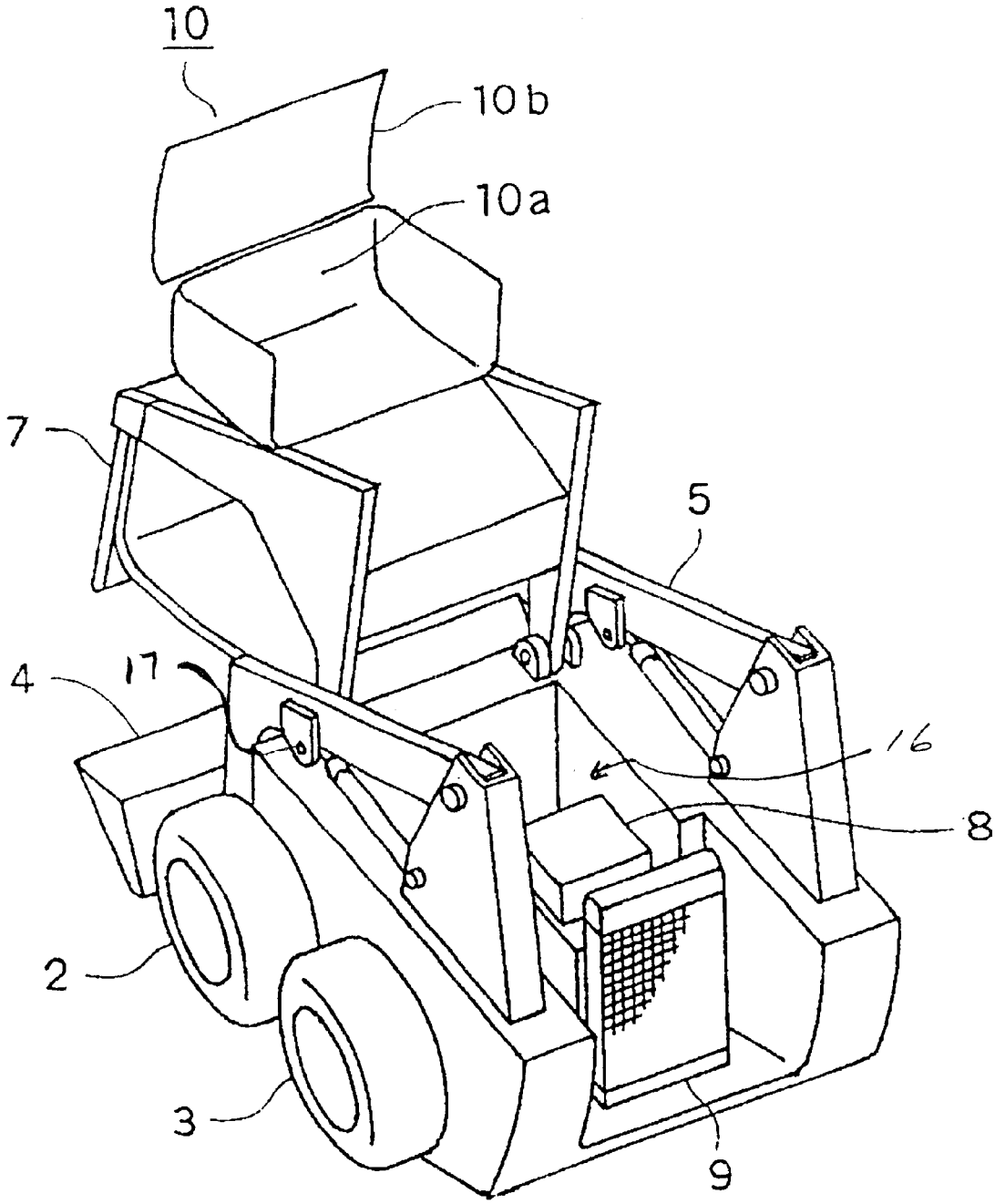
FIG. 2 is a perspective view of the first embodiment, slightly modified, showing the cab rotated or pivoted in a direction away from the rear of the work vehicle.

Referring to the drawings and more particularly to FIGS. 1 and 2, a simplified view of a work vehicle is shown according to the first embodiment. Frame 1 of this work vehicle is supported by front wheel 2 and rear wheel 3 arranged respectively at both the left and right sides thereof. The work equipment 5 includes a bucket 4. A cab 7 accommodates a driver's seat 6 and covers an engine compartment 16. An engine 8 is mounted in the engine compartment 16 at the rear of the work vehicle.

A radiator 9 as well as hydraulic equipment are also arranged at the rear of the work vehicle. The hydraulic equipment is not illustrated in order to avoid unnecessarily complicating the drawings. Such equipment may be mounted on the frame 1 under the driver's seat for example. The equipment 5, bucket 4, cab 7, engine 8 and radiator 9 are all mounted on the frame.

Work equipment 5 is provided at the front of the vehicle body and engine 8 is mounted at the rear of the vehicle body in order to improve stability in the longitudinal direction of the vehicle during operation. The bottom front end of cab 7 is pivoted at the top surface of frame 1 by pivoting means in the form of a hinge 17, allowing free rotation or pivoting forward away from the rear of the vehicle. Also, a latching device, which latches cab 7 to frame 1 may be provided at the bottom rear part of the cab.

The engine compartment 16 provides a space at the bottom rear part of cab 7. The top front part of engine 8 is accommodated within this space when cab 7 is installed on frame 1. Also, the engine hood is pivotally mounted to the rear surface of cab 7 to freely rotate in the vertical direction. The engine hood 10 includes an upper rear panel 10*a* which is privotally mounted on the cab 7 and a lower rear panel 10*b* pivotally mounted on the panel 10*a*. The hood 10 covers the top and left and right sides of engine 8 and radiator 9, and the rear surface of radiator 9.

When performing daily inspection of the engine 8, any hydraulic equipment, etc., only the engine hood 10 need be opened since it is not necessary to fully expose the engine compartment. In this opening operation, engine hood 10 flips upward as indicated, by the broken line in FIG. 1. Therefore, rotating or pivoting the heavy cab is not necessary during routine daily inspection. Inspection or repair of the radiator 9 may be accomplished by pivoting the rear panel 10*b* upwardly.

However, when repairing or replacing engine 8, the hydraulic equipment, or other equipment, etc., installed below the cab in the engine compartment, cab 7 is rotated or pivoted forward. In this case, the engine hood 10 is opened first and the latching device of cab 7 is released. Then, cab 7 is rotated forward, away from the rear of the vehicle. By means of this operation, hydraulic equipment (not shown in the figure), engine 8, and other equipment located at the bottom rear of cab 7 are exposed as shown in FIG. 2. Thus repairing, replacing work, etc., can easily be performed.

As shown if FIG. 2, the engine hood can consist of two parts 10*a,* 10*b*.

Figure 3:
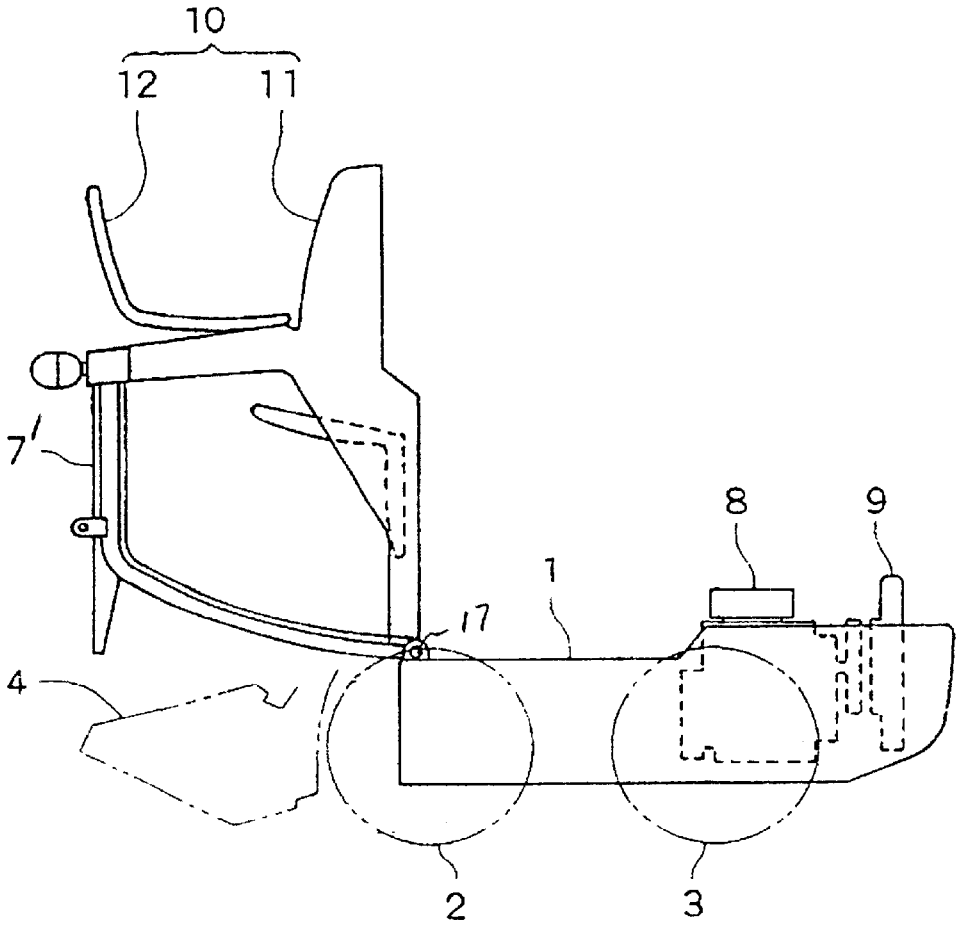
FIG. 3 is a side view of another embodiment of a work vehicle incorporating the principles of the present invention showing the cab pivoted or rotated away from the rear of the vehicle.

Referring now to FIG. 3, a side view of another embodiment of the present invention is illustrated. This embodiment divides the engine hood into side plates 11 and a cover plate 12. The left and right side plates 11 are fixed to the bottom rear part of a cab 7. Thus side plates 11 are integrally formed with the cab 7. Also, cover plate 12, which covers the top of engine 8 and the rear surface of radiator 9 is pivotally mounted on the rear surface of cab 7 to rotate freely. Thus cover plate 12 can be manipulated more easily than the engine hood in the first embodiment of the present invention.

Accordingly, it is clear that the work vehicle apparatus incorporating the principles of the present invention makes it possible to work efficiently both during a daily routine inspection of the vehicle and during a major repair or replacement of the engine and the hydraulic equipment in such work vehicle. Note that it is possible with the above-described arrangements for the cab to rotate at least 90 degrees with respect to its engine compartment covering a position. Similarly, the engine hood can rotate substantially 90 degrees with respect to the cab.

The invention has been described above in detail with respect to several preferred embodiments. However, it is clear that various modifications can be carried out within the scope of the present invention which is defined by the following claims.

What claimed is:

1. In a work vehicle having a frame and an engine arranged in a rear mounted engine compartment, apparatus comprising:

a cab mounted between front and rear ends of said vehicle for accommodating a vehicle operator and covering said engine compartment;

pivoting means coupled to said cab and said frame for permitting said cab to be pivoted away from the rear of said vehicle and uncover said engine compartment when desired; and an engine hood covering said engine and pivotally coupled to said cab, wherein said engine hood can be pivoted separately from said cab to expose said engine and said cab and engine hood together can be pivoted away from the rear of said vehicle to uncover and expose said engine compartment.

2. Apparatus as claimed in claim 1 wherein said engine hood comprises side plates and a cover plate and said cover plate is pivotally mounted to expose said engine.

3. Apparatus as claimed in claim 1 wherein said engine hood comprises side plates fixedly mounted on said cab and a cover plate pivotally mounted on said side plates to expose said engine when said cover plate is pivoted.

4. Apparatus as claimed in claim 3 wherein said side plates are integrally formed with said cab so as to pivot with said cab.

5. Apparatus as claimed in claim 1 wherein said cab is free to rotate at least ninety degrees from its engine compartment covering position by said pivoting means.

6. Apparatus as claimed in claim 1 wherein said engine hood is free to rotate substantially ninety degrees with respect to said engine.

* * * * *